US007028601B2

(12) United States Patent
Yoon et al.

(10) Patent No.: US 7,028,601 B2
(45) Date of Patent: Apr. 18, 2006

(54) ABRASION PREVENTIVE STRUCTURE OF RECIPROCATING COMPRESSOR

(75) Inventors: Hyung-Pyo Yoon, Changwon (KR); Kyeong-Weon Lee, Masan (KR)

(73) Assignee: LG Electronics Inc., (KR)

( * ) Notice: Subject to any disclaimer, the term of this patent is extended or adjusted under 35 U.S.C. 154(b) by 0 days.

(21) Appl. No.: 10/474,940

(22) PCT Filed: Oct. 31, 2002

(86) PCT No.: PCT/KR02/02034

§ 371 (c)(1),
(2), (4) Date: Oct. 16, 2003

(87) PCT Pub. No.: WO03/040561

PCT Pub. Date: May 15, 2003

(65) Prior Publication Data

US 2005/0098031 A1 May 12, 2005

(30) Foreign Application Priority Data

Nov. 8, 2001 (KR) ..... 2001-69544
Mar. 12, 2002 (KR) ..... 2002-13330

(51) Int. Cl.
*F01B 31/00* (2006.01)

(52) U.S. Cl. ..... 92/130 C; 92/130 D; 92/155

(58) Field of Classification Search ..... 92/130 R, 92/155, 130 C, 130 D
See application file for complete search history.

(56) References Cited

U.S. PATENT DOCUMENTS 4,347,046 A * 8/1982 Brucken et al. ..... 417/269
5,890,415 A * 4/1999 Asou ..... 92/128
5,941,161 A * 8/1999 Kimura et al. ..... 92/155
6,398,523 B1 * 6/2002 Hur et al. ..... 417/417
6,752,332 B1 * 6/2004 Terakado et al. ..... 239/585.1

FOREIGN PATENT DOCUMENTS

| | | |
|---|---|---|
| JP | 61015998 | 1/1986 |
| JP | 2000-291545 | 10/2000 |
| JP | 2000291545 | 10/2000 |
| JP | 2001-200390 | 7/2001 |
| JP | 2001200390 | 7/2001 |
| JP | 2001-234858 | 8/2001 |
| JP | 2001234858 | 8/2001 |
| WO | 01/50020 A1 | 7/2001 |

OTHER PUBLICATIONS

English translation of Chinese Office Action issued Aug. 26, 2005 in connection with corresponding Chinese application no.028053907.

(Continued)

*Primary Examiner*—Edward K. Look
*Assistant Examiner*—Devin Hanan
(74) *Attorney, Agent, or Firm*—Ostrolenk, Faber, Gerb & Soffen, LLP

(57) ABSTRACT

In an abrasion preventive structure of a reciprocating compressor, by forming a coating layer made of Ni—P alloy material having high hardness onto the surface of a frame at which front (92) and rear (93) resonance springs are contacted or spring mounting grooves (91*a*, 92*a*) of a spring supporting rod (91) or spring fixation protrusions or the inner circumference of a cylinder built-in type frame, although each resonance spring (92, 93) is rotated while repeating compression/relaxation, it is possible to prevent abrasion of the spring mounting grooves (91*a*, 92*a*) or the spring fixation protrusions, and accordingly reliability of the compressor can be improved.

10 Claims, 4 Drawing Sheets

OTHER PUBLICATIONS

Proposed claim amendments to Chinese application no. 028053907.

Proposed claims for Chinese application no. 028053907 without revision indications.

Untranslated Office Action issued by Chinese Patent Office on Aug. 26, 2005 in connection with corresponding Chinese application no. 028053907.

* cited by examiner

ABRASION PREVENTIVE STRUCTURE OF RECIPROCATING COMPRESSOR

TECHNICAL FIELD

The present invention relates to a reciprocating compressor, and in particular to an abrasion preventive structure of a reciprocating compressor which is capable of preventing abrasion at contact portions of construction parts, reducing the number of construction parts and simplifying fabrication process and assembly measure management of the construction parts.

BACKGROUND ART

In general, a reciprocating compressor sucks, compresses and discharges gas while a piston performs a liner reciprocating motion inside a cylinder. FIG. 1 is a longitudinal sectional view illustrating the conventional reciprocating compressor.

As depicted in FIG. 1, the reciprocating compressor includes a cylindrical container 10; a reciprocating motor 20 disposed in the container 10 and generating a linear reciprocating driving force; a rear frame 30 and a middle frame 40 respectively supporting the both sides of the reciprocating motor 20; a front frame 50 combined with the middle frame 40; a cylinder 60 fixedly combined with the frame 50 with a certain distance from the reciprocating motor 20; a piston 70 connected to the reciprocating motor 20, inserted into the cylinder 60 and performing a linear reciprocating motion inside the cylinder 60 by receiving the linear reciprocating driving force of the reciprocating motor 20; a compression unit 80 combined with the cylinder 60 and the piston 70, sucking and discharging gas inside the cylinder 60 by a pressure difference generated by the reciprocating motion; and a resonance spring unit 90 for elastically supporting the linear reciprocating motion of the reciprocating motor 20 and the piston 70.

And, the reciprocating motor 20 includes an outer stator 21 having a cylindrical shape and fixedly combined with the rear frame 30 and the middle frame 40; an inner stator 22 inserted into the outer stator 21 with a certain interval; a wound coil 23 combined with the outer stator 21; and a mover 24 inserted between the outer stator 21 and the inner stator 22 so as to perform the linear reciprocating motion.

And, the mover 24 includes a magnetic holder 25 having a cylindrical shape and plural permanent magnets 26 combined with the magnetic holder 25 at regular intervals, herein, the magnetic holder 25 is connected to the piston 70.

And, the compression unit 80 includes a discharge cover 81 for covering a compression space (P) of the cylinder 60; a discharge valve 82 disposed in the discharge cover 81 and opening/closing the compression space (P) of the cylinder 60; a valve spring 83 for elastically supporting the discharge valve 82; and a suction valve 84 combined with the end of the piston 70 and opening/closing a suction path (F) formed inside the piston 70.

And, the resonance spring unit 90 includes a spring supporting rod 91 curved-formed so as to have a certain area and combined with a certain side of the piston 70 or the mover 24 so as to place between the front frame 50 and the middle frame 40; plural front resonance springs 92 placed between the front frame 50 and the spring supporting rod 91; and plural rear resonance springs 93 placed between the spring supporting rod 91 and the middle frame 40.

And, as depicted in FIG. 2, plural spring mounting grooves 91*a* are formed at the internal surface of the front frame 50 and the front of the spring supporting rod 91 as the number of the front resonance springs 92 to insert-fix the front resonance springs 92 forcibly. In addition, plural spring mounting grooves 92*a* are formed at the rear of the spring supporting rod 91 and the front of the middle frame 50 to fix the rear resonance springs 93.

In more detail, the resonance spring unit 90 is respectively combined with the both sides of the spring supporting rod 91 in which the mover 24 of the reciprocating motor 20 and the piston 70 are combined together in order to induce the resonance motion of the mover 24 and the piston 70, and it includes the front resonance springs 92 arranged on the piston side and the rear resonance springs 93 arranged on the reciprocating motor side as compression coil springs.

And, plural spring fixation protrusions 94 are respectively formed at the both sides (left and right) of the spring supporting rod 91 in order to insert-fix the front resonance springs 92 and the rear resonance springs 93 forcibly.

In drawings, reference numeral SP is a suction pipe, and DP is a discharge pipe.

Hereinafter, the operation of the conventional reciprocating compressor will be described.

First, when power is supplied to the reciprocating motor 20 and current flows on the wound coil 23, by mutual operation between a flux formed on the outer stator 21 and the inner stator 22 by the current flowing on the wound coil 23 and the permanent magnets 26, the mover 24 including the permanent magnets 26 performs the linear reciprocating motion.

The linear reciprocating driving force of the mover 24 is transmitted to the piston 70, the piston 70 performs the linear reciprocating motion inside the cylinder compressor space (P) and simultaneously the compression unit 80 is operated, and accordingly gas is sucked into the cylinder compression space (P), is compressed and is discharged repeatedly.

And, the resonance spring unit 90 stores-releases the linear reciprocating driving force of the reciprocating motor 20 as elastic energy and induces the resonance motion.

However, in the conventional reciprocating compressor, because the cylinder 60 is combined with the front frame 50, the combining portion between them has to be precisely processed, it is intricate to fabricate the frame 50 and the cylinder 60 precisely, and accordingly assembly productivity is lowered and relatively lots of construction parts are required.

When assembly of the front frame 50 and the cylinder 60 is not precise, due to the assembly error between the piston 70 and the cylinder 60, compression gas may leak or abrasion may occur on the contact portion between the cylinder 60 and the piston 70, interference or contact may occur among the outer stator 21, the inner stator 22 and the mover 24 of the reciprocating motor inserted therebetween, and accordingly parts may be damaged.

In addition, in the conventional reciprocating compressor, by the elastic force owing to the compression coil spring shape, the front resonance springs 92 and the rear resonance springs 93 tend to rotate while repeating compression/relaxation. In that process, because the spring mounting grooves 91*a*, 92*a* and the spring fixation protrusions 92 contacted to the resonance springs 92, 93 may be continually worn away, the front and rear resonance springs 92, 93 may deviate from the fixation positions, at the worst the resonance springs 92, 93 may break away, and accordingly reliability of the compressor is lowered.

TECHNICAL GIST OF THE PRESENT INVENTION

In order to solve the above-described problems, it is an object of the present invention to provide an abrasion preventive structure of a reciprocating compressor which is capable of preventing abrasion of contact portions inside a compressor from occurring, reducing the number of construction parts for compressing gas and simplifying fabrication and assembly of the construction parts.

In order to achieve the above-mentioned objects, in a reciprocating compressor including a cylindrical container; a frame supported elastically inside the container; a reciprocating motor disposed in the frame and performing a linear reciprocating motion; a piston combined with a mover of the reciprocating motor and sucking/compressing fluid in the linear reciprocating motion; a cylinder receiving the piston movably and fixed to the frame so as to form a compression space; and plural resonance springs arranged between the mover or a spring supporting rod combined with the mover and the frame to make the mover of the reciprocating motor and the piston resonate together, an abrasion preventive structure of a reciprocating compressor in accordance with the present invention includes a surface reinforcing layer formed at contact portions of construction parts.

In addition, in order to achieve the above-mentioned objects, in a reciprocating compressor including a cylindrical container; a frame supported elastically inside the container; a reciprocating motor disposed in the frame and performing a linear reciprocating motion; a piston combined with a mover of the reciprocating motor and sucking/compressing fluid in the linear reciprocating motion; a cylinder receiving the piston movably and fixed to the frame so as to form a compression space; and plural resonance springs arranged between the mover or a spring supporting rod combined with the mover and the frame to make the mover of the reciprocating motor and the piston resonate together, an abrasion preventive structure of a reciprocating compressor in accordance with the present invention includes the frame constructed as a cylinder built-in type frame having a piston insertion hole; and a surface reinforcing layer made of material having lubricating ability and abrasion resistance and coated onto the inner circumference of the piston insertion groove of the cylinder built-in type frame.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, the preferred embodiment of the present invention will be described with reference to accompanying drawings.

Figure 1:
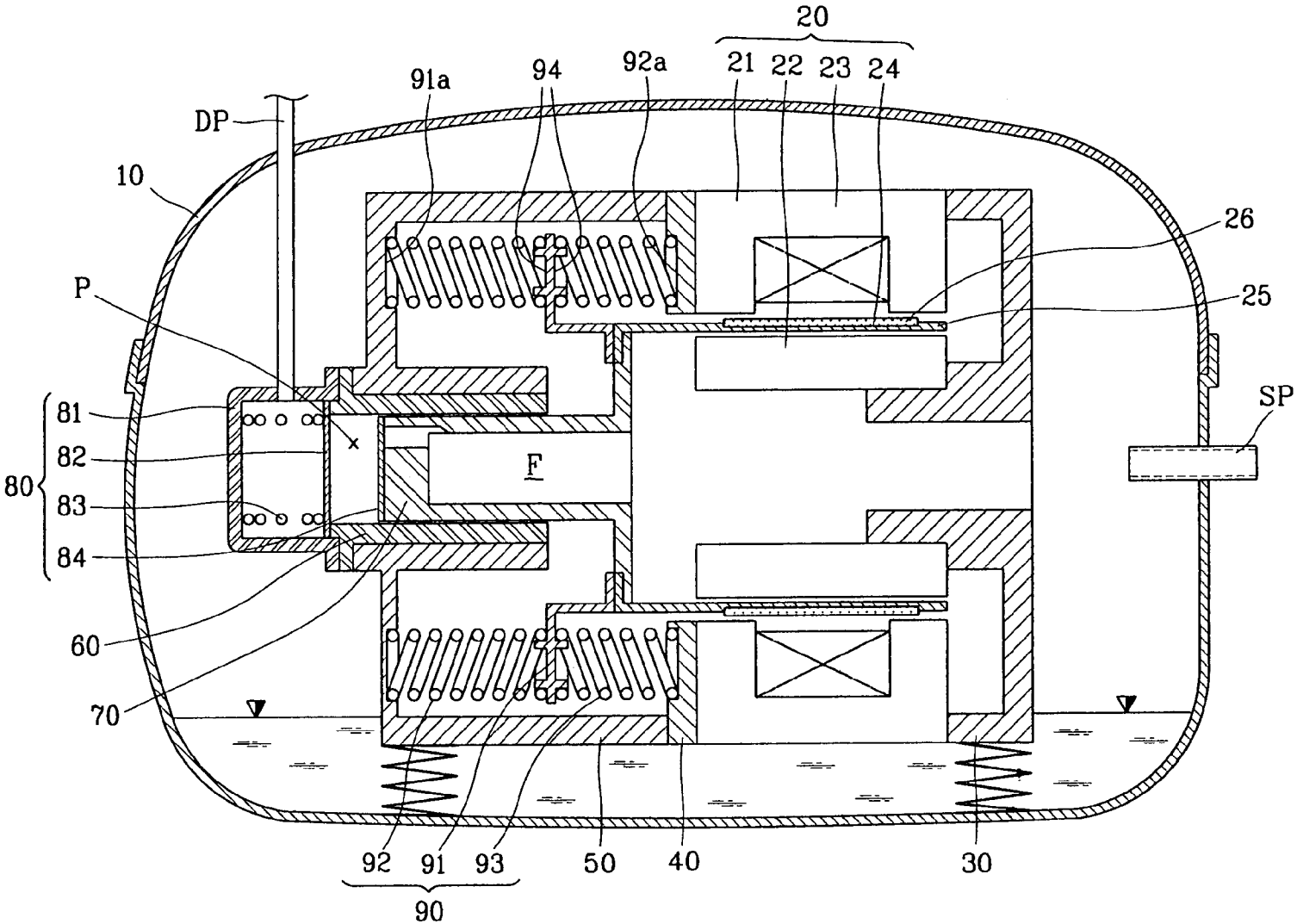
FIG. 1 is a longitudinal sectional view illustrating the conventional reciprocating compressor.
Figure 2:
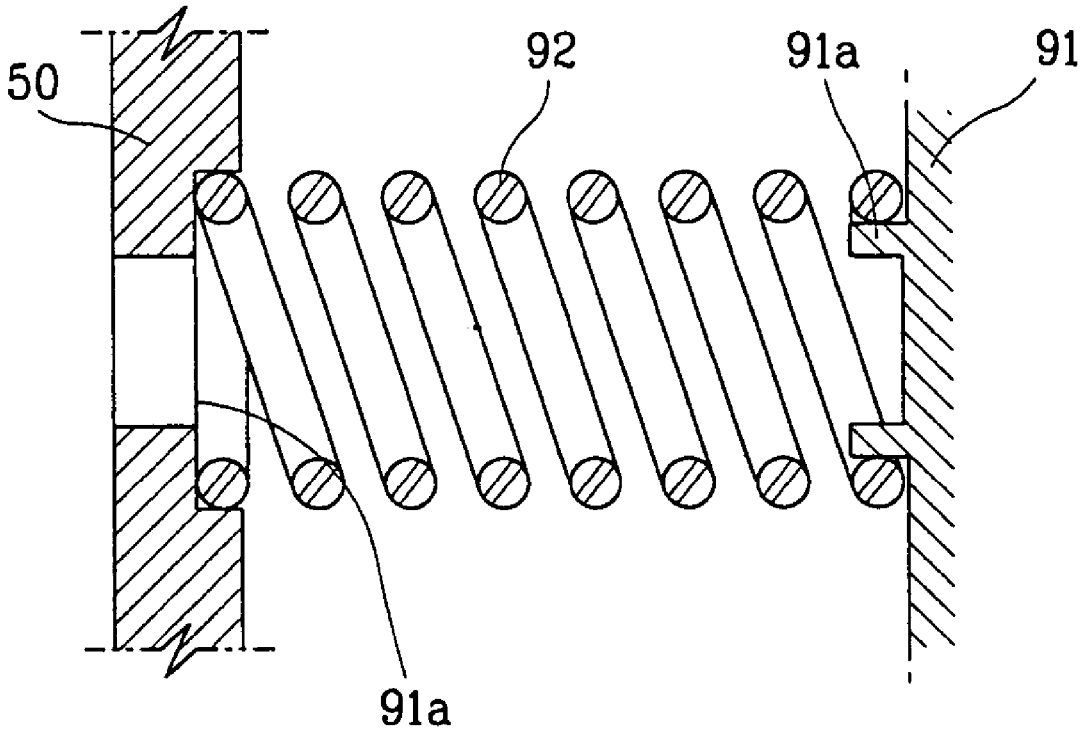
FIG. 2 is a longitudinal sectional view illustrating a fixation portion of a resonance spring of the conventional reciprocating compressor.
Figure 3:
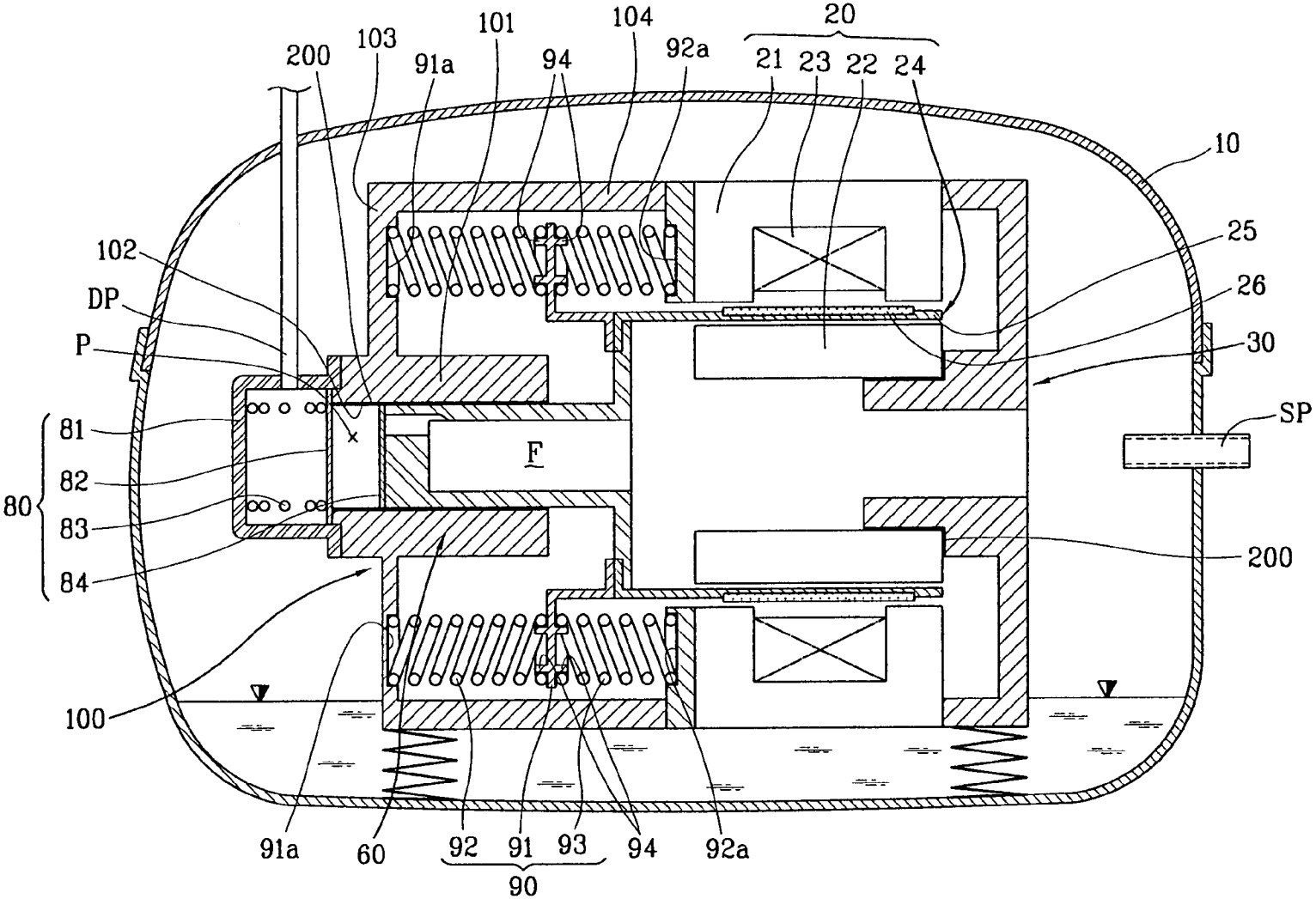
FIG. 3 is a sectional view illustrating a reciprocating compressor having an abrasion preventive structure in accordance with the present invention.
Figure 4:
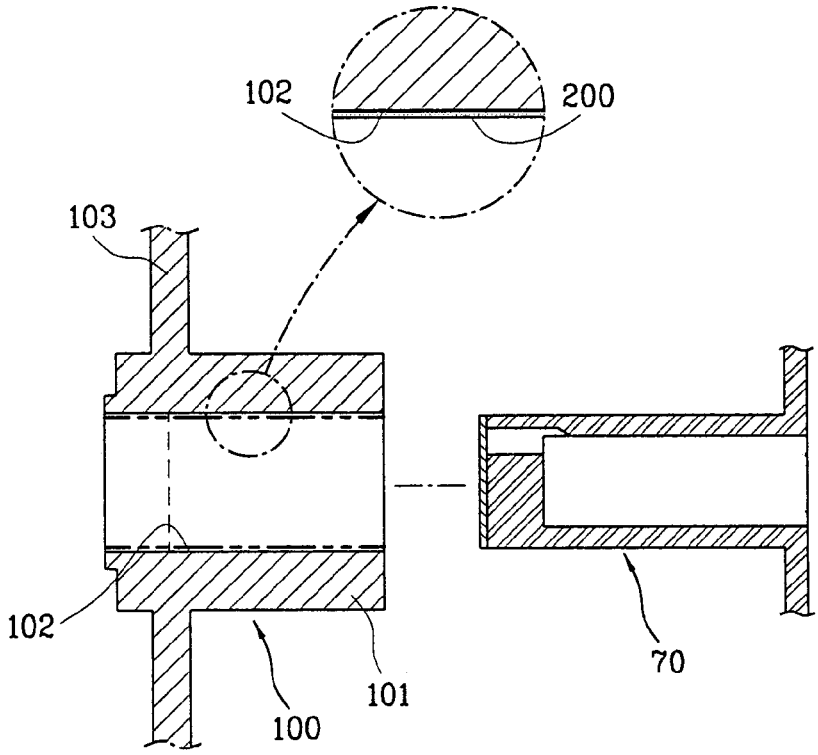
FIG. 4 is a sectional view illustrating the abrasion preventive structure of the reciprocating compressor in accordance with the present invention.

FIG. 3 is a sectional view illustrating a reciprocating compressor having an abrasion preventive structure in accordance with the present invention; FIG. 4 is a sectional view illustrating the abrasion preventive structure of the reciprocating compressor in accordance with the present invention; and FIG. 5 is a longitudinal sectional view illustrating a fixation portion of a resonance spring in the abrasion preventive structure of the reciprocating compressor in accordance with the present invention.

Figure 5:
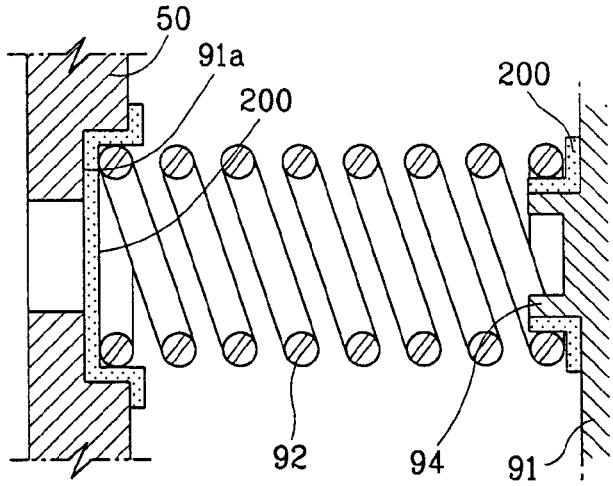
FIG. 5 is a longitudinal sectional view illustrating a fixation portion of a resonance spring in the abrasion preventive structure of the reciprocating compressor in accordance with the present invention.

With reference to FIGS. 3~5, in the reciprocating compressor, first a reciprocating motor 20 for generating linear reciprocating driving force is disposed in a container 10 having a certain shape, and a rear frame 30 and a middle frame 40 are respectively combined with the both sides of the reciprocating motor 20.

The reciprocating motor 20 includes an outer stator 21 having a cylindrical shape and fixedly combined with the rear frame 30 and the middle frame 40; an inner stator 22 inserted into the outer stator 21 with a certain interval; a wound coil 23 combined with the outer stator 21; and a mover 24 inserted between the outer stator 21 and the inner stator 22 so as to perform the linear reciprocating motion.

The mover 24 includes a magnetic holder 25 having a cylindrical shape and plural permanent magnets 26 combined with the magnetic holder 25 at regular intervals.

And, a cylinder built-in type frame 100 having a certain shape is combined with the middle frame 40. In the cylinder built-in type frame 100, a piston insertion hole 102 having a certain inner diameter is formed at the center of a frame body 101 having a certain length and outer diameter, a plate portion 103 is extended-formed at a certain side of the outer circumference of the frame body 101 so as to have a certain area, and an interval maintaining portion 104 is formed by being extended from the edge of the plate portion 103 so as to have a certain depth and is supported by the middle frame 40.

And, a surface reinforcing layer 200 having lubricating ability and abrasion resistance is coated onto the inner circumference of the piston insertion groove 102 of the cylinder built-in type frame 100.

It is preferable for the cylinder built-in type frame 100 to be made of aluminum material, and it is preferable for the surface reinforcing layer to be made of Ni—P alloy material.

In addition, it is preferable to fabricate the cylinder built-in type frame 100 by a die-casting process in the productivity and production cost aspects.

And, a piston 70 having a certain shape is inserted into the piston insertion hole 102 of the cylinder built-in type frame 100, and the piston 70 is combined with the magnetic holder 25 of the mover 24 of the reciprocating motor 20.

In more detail, a compression space (P) is constructed by the piston insertion hole 102 of the cylinder built-in type frame 100 and the piston 70 inserted therein.

And, a resonance spring unit 90 is arranged between the cylinder built-in type frame 100 and the middle frame 40 in order to support the motion of the mover 24 of the reciprocating motor 20 and the piston 70 elastically.

In more detail, the resonance spring unit 90 includes a spring supporting rod 91 curved-formed so as to have a certain area and combined with a certain side of the piston 70 or the mover 24 so as to place between the cylinder built-in type frame 100 and the middle frame 40; front resonance springs 92 placed between the cylinder built-in type frame 100 and the spring supporting rod 91; and rear resonance springs 93 placed between the spring supporting rod 91 and the middle frame 40.

And, the resonance spring unit 90 is respectively combined with the both sides of the spring supporting rod 91 in which the mover 24 of the reciprocating motor 20 combines with the piston 60 and induces the resonance motion of the mover 24 and the piston 70.

Herein, spring mounting grooves 91*a*, 92*a* and spring supporting protrusions 94 are formed at the internal surface of the cylinder built-in type frame 100, a certain side of the middle frame 40 and the both sides of the spring supporting rod 91 facing them (the internal surface of the cylinder built-in type frame 100 and a certain side of the middle frame 40) in order to mount or insert the both ends of the front and rear resonance springs 92, 93 respectively.

And, the surface reinforcing layer 200 made of Ni—P alloy material is formed onto the combining surface between the rear frame 30 and the inner stator 22 in order to restrain burr occurrence in combining of the inner stator 22 with the rear frame 30. And, a surface reinforcing later made of Ni—P alloy material can be formed onto the inner or outer circumference of an oil cylinder (not shown) and an oil piston (not shown) disposed in a lubricant supply unit (not shown) combined with the lower portion of the front frame 50.

And, a compression unit 80 is combined with the cylinder 60 and the piston 70 and sucks/discharges gas into the cylinder 60 by a pressure difference occurred in the linear reciprocating motion of the piston 70 inside the cylinder 60.

The compression unit 80 includes a discharge cover 81 for covering a compression space (P) of the cylinder 60; a discharge valve 82 disposed in the discharge cover 81 and opening/closing the compression space(P) of the cylinder built-in type frame 100; a valve spring 83 for elastically supporting the discharge valve 82; and a suction valve 84 combined with the end of the piston 70 and opening/closing a suction path (F) formed inside the piston 70.

The same reference numerals are given to the parts same with the conventional art.

In drawings, SP is a suction pipe, and DP is a discharge pipe.

Hereinafter, the operation of the gas compression structure of the reciprocating compressor in accordance with the present invention will be described.

First, when power is supplied to the reciprocating motor 20 and current flows on the wound coil 23, by mutual operation between a flux formed on the outer stator 21 and the inner stator 22 by the current flowing on the wound coil 23 and the permanent magnets 26, the mover 24 including the permanent magnets 26 performs the linear reciprocating motion.

And, the linear reciprocating driving force of the mover 24 is transmitted to the piston 70, the piston 70 performs the linear reciprocating motion in the piston insertion hole 102 of the cylinder built-in type frame 100 and simultaneously the compression unit 80 is operated, and accordingly refrigerant gas is sucked into the compression space (P) of the cylinder built-in type frame 100, is compressed and is discharged repeatedly.

And, the resonance spring unit 90 stores-releases the linear reciprocating driving force of the reciprocating motor 20 as elastic energy and induces the resonance motion.

Accordingly, in the abrasion preventive structure of the reciprocating compressor in accordance with the present invention, the piston insertion hole 102 for receiving the piston 70 is formed at the cylinder built-in type frame 100, the piston 70 is inserted into the piston insertion hole 102 of the cylinder built-in type frame 100, and accordingly it is possible to simplify the construction parts. In addition, the surface reinforcing layer 200 is coated onto the inner circumference of the piston insertion hole 102 of the cylinder built-in type frame 100, it is possible to minimize friction and abrasion between the outer circumference of the piston 70 and the inner circumference of the piston insertion hole 102 of the cylinder built-in type frame 100 in the linear reciprocating motion of the piston 70.

In the meantime, the piston insertion hole 102 for receiving the piston 70 is formed at the cylinder built-in type frame 100, the piston 70 is inserted into the piston insertion hole 102 of the cylinder built-in type frame 100, it is possible to simplify the assembly process and facilitate the assembly measure management. In addition, it is possible to facilitate measure management of the mover 24 combined with the piston 70 and arranged between the outer stator 21 and the inner stator 22.

In addition, in the conventional reciprocating compressor, by the elastic force owing to the shape of the compression coil spring, the front resonance springs 92 and the rear resonance springs 93 tend to rotate while repeating compression/relaxation. In that process, because the spring mounting grooves 91*a*, 92*a* and the spring fixation protrusions 92 contacted to the resonance springs 92, 93 may be continually worn away, the resonance springs 92, 93 may deviate from the fixation positions, at the worst the resonance springs 92, 93 may break away, and accordingly reliability of the compressor is lowered. However, in the present invention, by forming the surface reinforcing layer made of Ni—P alloy material having high hardness at the inner surface of the spring mounting grooves 91*a*, 92*a* and the outer surface of the spring fixation protrusions 94, it is possible to prevent abrasion of the mounting grooves 91*a*, 92*a* and the spring fixation protrusions 94 from occurring.

As described above, in the operation of the compressor, by preventing friction and abrasion of the cylinder built-in type frame 100 at which the front and rear resonance springs 92, 93 as the compression coil springs are contacted or the middle frame 40 and the spring supporting rod 91, deviation or breakaway of the springs 92, 93 can be prevented, and accordingly reliability of the compressor can be improved.

INDUSTRIAL APPLICABILITY

As described above, in the abrasion preventive structure of the reciprocating compressor in accordance with the present invention, by forming a reinforcing layer made of Ni—P alloy material having high hardness at a frame at which front and rear resonance springs are contacted or spring mounting grooves of a spring supporting rod or spring fixation protrusions and the inner circumference of a cylinder built-in type frame, although each resonance spring is rotated while repeating compression/relaxation, it is possible to prevent abrasion of the spring mounting groove or the spring fixation protrusion, and accordingly reliability of the compressor can be improved.

In addition, in the abrasion preventive structure of the reciprocating compressor in accordance with the present invention, it is possible to reduce the number of construction parts for compressing gas and simplify process and assembly of the construction parts.

What is claimed is:

1. In a reciprocating compressor including a cylindrical container; a frame supported elastically inside the container; a reciprocating motor disposed in the frame and performing a linear reciprocating motion; a piston combined with a mover of the reciprocating motor and sucking/compressing fluid in the linear reciprocating motion; a cylinder receiving the piston movably and fixed to the frame so as to form a compression space; and plural resonance springs arranged between the mover or a spring supporting rod combined with the mover and the frame to make the mover of the reciprocating motor and the piston resonate together, an abrasion preventive structure of a reciprocating compressor, comprising:

a surface reinforcing layer formed at the surface of the frame and the mover or the surface of the spring supporting rod combined with the mover, at which, ends of each resonance spring are contacted.

2. The structure of claim 1, wherein the surface reinforcing layer is formed by coating Ni—P alloy material.

3. The structure of claim 1, wherein plural spring mounting grooves or plural spring fixation protrusions for mounting/inserting the plural resonance springs are formed at the frame and the mover at which the end of the plural resonance springs are contacted or the spring supporting rod combined with the mover, and a surface reinforcing layer is respectively formed onto the inner surface of the spring mounting groove or the outer surface of the spring fixation protrusion.

4. The structure of claim 1, wherein a surface reinforcing layer made of Ni—P alloy material is coated onto the inner or outer circumference of an oil cylinder and an oil piston disposed in a lubricant supply unit combined with the lower portion of a front frame of the frame.

5. The structure of claim 1, wherein a surface reinforcing layer is formed onto the combining surface of a rear frame of the frame at which an inner stator is combined.

6. In a reciprocating compressor including a cylindrical container; a frame supported elastically inside the container; a reciprocating motor disposed in the frame and performing a linear reciprocating motion; a piston combined with a mover of the reciprocating motor and sucking/compressing fluid in the linear reciprocating motion; a cylinder receiving the piston movably and fixed to the frame so as to form a compression space; and plural resonance springs arranged between the mover or a spring supporting rod combined with the mover and the frame to make the mover of the reciprocating motor and the piston resonate together, an abrasion preventive structure of a reciprocating compressor, comprising:

plural spring mounting grooves or plural spring fixation protrusions for mounting/inserting the plural resonance springs are provided at the frame and the mover or the spring supporting rod combined with the mover, at which, ends of the plural resonance springs are contacted; and a surface reinforcing layer respectively provided onto the inner surface of the spring mounting groove or the outer surface of the spring fixation protrusion.

7. The structure of claim 6, wherein the surface reinforcing layer is formed by coating Ni—P alloy material.

8. The structure of claim 6, wherein the surface reinforcing layer is provided at the surface of the frame and the mover at which the end of each resonance spring is contacted or the surface of the spring supporting rod combined with the mover.

9. The structure of claim 6, wherein a surface reinforcing layer made of Ni—P alloy material is provided onto the inner or outer circumference of an oil cylinder and an oil piston disposed in a lubricant supply unit combined with the lower portion of a front frame of the frame.

10. The structure of claim 6, wherein a surface reinforcing layer is provided onto the combining surface of a rear frame of the frame at which an inner stator is combined.

* * * * *